US005625160A

United States Patent [19]

Rudolf et al.

[11] Patent Number: 5,625,160

[45] Date of Patent: Apr. 29, 1997

[54] PROTECTION ARRANGEMENT FOR AFFORDING PROTECTION FROM AN APPROACHING PROJECTILE

[75] Inventors: Karl Rudolf, Schrobenhausen; Raimar Steuer, Diepersdorf, both of Germany

[73] Assignee: Diehl GmbH & Co., Nuremberg, Germany

[21] Appl. No.: 602,334

[22] Filed: Feb. 16, 1996

[30] Foreign Application Priority Data

Feb. 18, 1995 [DE] Germany ..... 195 05 629.9

[51] Int. Cl.[6] ..... F41H 11/00

[52] U.S. Cl. ..... 89/36.17; 89/36.08

[58] Field of Search ..... 89/36.02, 36.08, 89/36.17, 36.04, 36.12, 36.13

[56] References Cited

U.S. PATENT DOCUMENTS

| | | | |
|---|---|---|---|
| 4,867,077 | 9/1989 | Marlow et al. | 109/36 |
| 4,869,152 | 9/1989 | Marlow et al. | 89/36.17 |
| 5,001,984 | 3/1991 | Jones et al. | 102/418 |
| 5,070,764 | 12/1991 | Shevach et al. | 89/36.17 |
| 5,293,806 | 3/1994 | Gonzalez | 89/36.03 |
| 5,413,027 | 5/1995 | Mixon | 89/36.17 |

FOREIGN PATENT DOCUMENTS

| | | |
|---|---|---|
| 35183 | 11/1988 | Austria . |
| 0161390 | 11/1985 | European Pat. Off. . |
| 207511 | 7/1991 | European Pat. Off. . |
| 588211 | 3/1994 | European Pat. Off. . |
| 2719150 | 3/1987 | Germany . |
| 3402428 | 8/1988 | Germany . |
| 3706775 | 9/1988 | Germany . |
| 4008395 | 9/1991 | Germany . |
| 4122622 | 1/1993 | Germany . |
| 4307160 | 9/1994 | Germany . |
| 1421379 | 1/1976 | United Kingdom . |
| 2200437 | 8/1988 | United Kingdom . |
| WO87/05994 | 10/1987 | WIPO . |

OTHER PUBLICATIONS

Hausher (1989) "Sowjetische Reaktiv–panzerung–was nun?", *ASMZ Nr. 2*: 73–75.

JP 3–67999 (1991) *Patent Abstracts of Japan*, M–1123, vol. 15, No. 228.

*Primary Examiner*—J. Woodrow Eldred

*Attorney, Agent, or Firm*—Scully, Scott, Murphy & Presser

[57] ABSTRACT

In a protection arrangement for affording protection from projectiles (13) attacking armoured vehicles (11) such as in particular combat tanks catapult-type plate modules (18) are no longer carried directly by the structure of the vehicle (11) to be protected but by a front mounting (17) which is of comparatively lightweight structure but which is rigid in respect of deformation by virtue of strut structure means of a three-dimensional framework-like configuration and which in particular is mounted in front of the front (16) of a combat tank body (12) but which can also be provided therearound. Upon triggering of a module (18) by a sensor (22) which is fixed with respect to the vehicle and which extrapolates the current attack trajectory (23) two plates (19) which are oriented in mutually parallel relationship are flung away in mutually opposite directions by the acceleration device (20) which is arranged centrally between the plates and which is for example electromagnetic or preferably pyrotechnic, so that the load-bearing front mounting (17) has to carry practically no acceleration reaction forces. One of the two plates (19) which are oriented approximately parallel to the attack trajectory (23) and which are accelerated transversely thereto hits the approaching projectile (13) laterally in the front region and thereby alters the angle of incidence, with a reduction in kinetic energy or triggering of the warhead, so that even impact against the vehicle (11) no longer results in penetration.

6 Claims, 1 Drawing Sheet

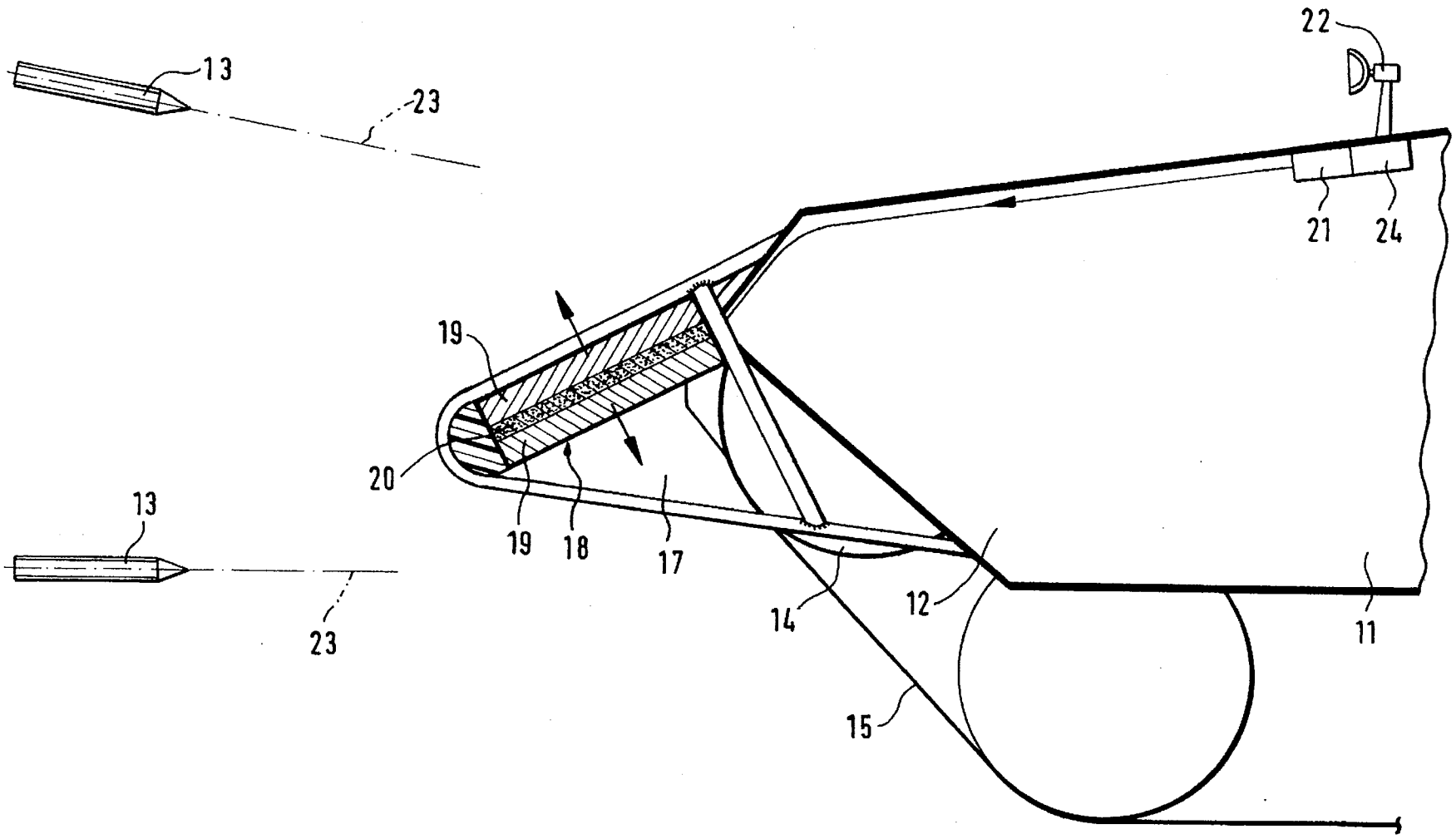
22
24
21
11
12
15
14
17
18
19
19
20
23
23
13
13

PROTECTION ARRANGEMENT FOR AFFORDING PROTECTION FROM AN APPROACHING PROJECTILE

FIELD OF THE INVENTION

The invention concerns a protection arrangement for attending protection from an approaching projectible.

A protection arrangement of that kind which is based on flinging an armour steel plate towards the approaching armour-piercing projectile shortly before target impact is described in German patent specification No 41 22 622. It is provided therein that the approaching projectile is detected by means of radar sensors whose antennae are integrated into the defence plates. Those sensors are intended to ensure that as far as possible only the one plate over the directly threatened location of the vehicle to be protected is triggered off and flung towards the approaching projectile in order prematurely to trigger off a warhead or prematurely to reduce the kinetic attacking energy by virtue of the plate colliding with the projectile, at a safe distance in front of the vehicle.

A problem with the practical configuration of such a protection arrangement however is that quite considerable reaction forces must be carried by the vehicle to be protected, to provide for the high degree of acceleration of the heavy plates, and such reaction forces in turn may already result in damage to parts which are essential to proper functioning in the vehicle to be protected. In the case of a combat tank there is also the point that it is rather the heavy turret than the body which is much more endangered in the main combat direction, that is suitable for carrying the reaction forces occurring when such plates are accelerated, and that when such plates which stand up really considerably with their electromagnetic or pyrotechnic acceleration devices are arranged on the front region of the body to be protected, the tank driver who operates in a protected situation loses sight of the ground beneath him in front of the tank so that he must control the tank virtually blind. In addition the body, in the front upper region, frequently serves to carry auxiliary devices (such as searchlights or smoke generators) which prohibit covering with defence plates, without any gaps, in order not to be adversely affected in terms of their function, and thus give rise to regions on the tank body which are critical as they are unprotected by defence plates.

In recognition of those factors the technical object of the present invention is so to design a defence arrangement of the general kind set forth that in particular the front region of the body of an armoured vehicle can be protected from attacking projectiles by means of defence plates which can be flung away, without thereby excessively loading the load-bearing structure and without thereby excessively limiting operational functions.

In accordance with the invention that object is essentially attained in that the defence arrangement of the general kind set forth is also designed in accordance with the features of the characterizing portion of the main claim.

In accordance with that construction the reaction force of the plate which is to be flung towards an attacking projectile is carried by a plate which is flung away in the opposite direction so that this sandwich structure, comprising two respective plates with an acceleration device disposed therebetween, can be carried by a relatively lightweight holder as a front mounting or projection in front of and/or beside the body. It is only to be of such a sturdy construction that it withstands clearing away any obstacles. By virtue of the defence plates being displaced into the region of the body front and in front thereof the surface of the body reins free to accommodate other equipment and in particular the view of the tank driver is not impaired by protection devices (plate modules) which are disposed on the body.

The plates are arranged approximately horizontally or slightly inclined relative to the horizontal in the front mounting which is wedge-shaped in longitudinal section and are no longer flung frontally towards a projectile which is flying in the opposite direction to the main combat direction, but along a collision path which is oriented approximately transversely with respect thereto. Triggering of a plate module in accordance with the direction of attack of a projectile to be defended against is again initiated by a sensor. The sensor now desirably includes a radar group antenna for electronically phasecontrolled beam sweep, as described for example in greater detail in European patent specification No 0 207 511. The aim of such a radar sensor (and possibly further supporting sensors which operate in other regions of the electromagnetic radiation spectrum) is also to ascertain which module that is still operational is under the extrapolated attack trajectory of a projectile to be defended against, in order to accelerate the plates of that module away from each other at that moment which results in collision, approximately along the longitudinal side, of one of the plates with the approaching projectile. That provides that the sensor does not have to distinguish whether the attacking trajectory is above or below the module holder because in any event a respective plate is accelerated in each of both directions.

Additional alternatives and developments and further features and advantages of the invention will be apparent from the further claims and, also having regard to the information in the Abstract, from the following description of a preferred embodiment of the structure according to the invention, which is shown diagrammatically in highly abstracted form in the drawing, being restricted to what is essential.

The single Figure of the drawing is a broken-away view in longitudinal section showing the front part of an armoured vehicle with a sturdy front mounting for carrying the protection arrangement for affording protection from approaching projectiles, having regard to under-calibre armour-piercing shells which approach from the main combat direction, above and below respectively.

The armoured vehicle 11 which is diagrammatically shown in the drawing in symbolic and greatly simplified form is for example a combat tank whose body 12 is to be protected in the main combat direction (that is to say in the direction of travel ahead) from the effect of armour-piercing projectiles 13. For that purpose, in prolongation of its body contour between the front guide rollers 14 of its tracks 15, the vehicle 11 carries a front mounting 17 which projects relatively far beyond the front end 16 and which is wedge-shaped in longitudinal section, as a grid-like holding structure for interchangeable or subsequently fittable sandwich modules 18, the holding structure having a shock-absorbing back cladding. The front mounting 17 is of a mechanically very robust structure, for example in the form of a tubular frame structure which is stiffened in a lattice-like fashion, and is at any event sufficiently robust in order thereby also to be able to push away obstacles or knock over trees without suffering serious damage.

Each of the modules 18 which is suspended in the frame-like front mounting 17 in a somewhat inclined position in accordance with the threat situation comprises a sandwich structure consisting of two armour steel plates 19 which are arranged parallel one above the other and between which is disposed an acceleration device 20, preferably in the form of a high-energy explosive layer. Triggering of one of those acceleration devices 20 can be individually initiated by way of a control device 21 and is effected in accordance with the information from a sensor 22 for detecting the trajectory 23 of a projectile 13 which is currently attacking.

The evaluation circuit 24 of the sensor 22 does not basically need to differentiate whether the projectile 13 to be defended against is attacking in the upper or the lower region of the body 12. The important consideration is that, on the basis of the extrapolated trajectory 23, the control device 21 is notified of which of the modules 18, which are still ready to operate, is to be activated, and (in accordance with the proximity factors which are given by way of the initial range and the closing speed), the time at which that module 18 is to be triggered off. Triggering actuation of the module 18 is therefore effected as far as possible precisely at the moment at which one of the two plates 19 which are to be accelerated away from each other transversely to their main planes, by virtue of the kinetic factors involved, meets the approaching projectile 13 in the region of its tip laterally thereof, before impact thereof against the body 12. In that way the warhead of an approaching missile with an armourpiercing charge is prematurely set off or energy is taken from an undersize-calibre projectile 13. The lateral collision of the projectile 13 with the plate 19 at a certain spacing in front of or over the body 12 may even result under some circumstances in the projectile 13 breaking up and possibly also in a certain deflection in the angle of approach, and at any event provides that in the end, even if the projectile 13 impacts against the vehicle 11 to be protected, because the impact situation is then much more unfavorable in energy terms, penetration can no longer occur.

In spite of the high level of energy with which the plates 19 are accelerated when the module 18 is operated, the resulting loading on the load-bearing mounting 17 is comparatively low; for, the mounting 17 does not need to carry any reaction force for accelerating one of the plates 19 because that is compensated by the oppositely accelerated plate 19. As therefore there is always one plate which is accelerated upwardly and one plate which is accelerated downwardly, that also means that, for controlling the missile defence, there is no need to distinguish whether the attack trajectory 23 is above or below the module 18 involved in terms of azimuth.

We claim:

1. A protective arrangement for affording protection from a threat to a vehicle (11) by an approaching projectile (13) comprising at least one module (18) including a plurality of plates (19); a sensor (22) for initiating an acceleration of at least one said plate from the vehicle (11) against said projectile; wherein said sensor (22) initiates the acceleration of respectively two of said plurality of plates (19) away from each other, said at least one module (18) being mounted in a front structure (17) carried by said vehicle (11).

2. A protective arrangement according to claim 1, wherein said at least one module has two mutually parallel arranged said plates (19) located on both sides of a pyrotechnic acceleration device (20).

3. A protective arrangement according to claim 1 or 2, wherein said plates (19) are mounted in the front structure (17) at an angle of incidence relative to an oncoming trajectory of said projectile.

4. A protective arrangement according to claim 1, wherein said front structure (17) has an acutely angled wedge-like configuration in longitudinal section and is arranged ahead of a front end (16) and extends laterally of a chassis (12) of said vehicle.

5. A protective arrangement according to claim 1, wherein said at least one module (18) is arranged in a grid-like frame work of said front structure (17).

6. A protective arrangement according to claim 1, wherein triggering of said at least one module (18) by said sensor is effected in conformance with an attack trajectory (23) of an approaching projectile (13), said trajectory being extrapolated by at least one said sensor (22) on board the vehicle (11).

* * * * *